United States Patent [19]

Anderka

[11] 4,130,444

[45] Dec. 19, 1978

[54] DEVICE FOR CLEANING INK PEN POINTS

[75] Inventor: Gerold Anderka, Ellerbek, Fed. Rep. of Germany

[73] Assignee: Koh-I-Noor Rapidograph, Inc., Bloomsbury, N.J.

[21] Appl. No.: 900,046

[22] Filed: Apr. 25, 1978

[30] Foreign Application Priority Data

Jun. 2, 1977 [DE] Fed. Rep. of Germany ..... 2724888

[51] Int. Cl.[2] ..... B08B 3/02

[52] U.S. Cl. ..... 134/96; 134/98

[58] Field of Search ..... 134/96, 97, 98, 99, 134/100, 94, 95, 102, 117, 166 R, 171, 22 R, 26, 201; 15/302, 409, 423, 341

[56] References Cited

U.S. PATENT DOCUMENTS

| | | | |
|---|---|---|---|
| 1,343,621 | 6/1920 | Garver | 134/166 R |
| 1,799,525 | 4/1931 | Morgan | 134/98 X |
| 2,480,346 | 8/1949 | Watts | 134/94 X |
| 2,484,149 | 10/1949 | Bousky | 134/96 X |
| 2,493,291 | 1/1950 | Hirsch | 134/98 X |
| 2,626,624 | 1/1953 | Holderith | 134/98 X |
| 2,634,735 | 4/1953 | Buck | 134/96 X |
| 2,710,984 | 6/1955 | Grueter | 15/302 X |
| 3,068,876 | 12/1962 | Taylor | 134/98 X |
| 3,832,752 | 9/1974 | Prochnow | 15/341 |

*Primary Examiner*—Stanley N. Gilreath
*Attorney, Agent, or Firm*—David H. Semmes

[57] ABSTRACT

A device for cleaning ink pen points of the type which are removable from an ink pen. The device includes an upper section and a lower section complementally engagable with each other, so as to support the pen point in a vertical attitude for sequential attack by cleaning water and drying air. The device includes a jet pump portion actuated by the cleaning water, so as to advance drying air through the pen point. The device is characterized by its mechanical simplicity, yet extreme effectiveness in cleaning artists and stylographic drafting pen points.

5 Claims, 2 Drawing Figures

DEVICE FOR CLEANING INK PEN POINTS

BACKGROUND OF THE INVENTION (1) Field of the Invention

Stylographic drafting pens, particularly devices for cleaning and removing dried ink particles from the capillary passages of drafting pen points.

SUMMARY OF THE INVENTION

A device for cleaning ink pen points, for example stylographic pen tubular points. The device includes a housing separable into an upper section and an lower section. The lower section includes a chamber for vertical support of a pen point to be cleaned. The upper section incluces an air inlet conduit and water inlet conduit communicable with the cleaning chamber. A two-way valve is rotatably supported in the upper section, so as to align the water inlet conduit with the cleaning chamber for water cleaning and sequentially to align the air inlet conduit with the chamber for air drying and removal of water. In the air drying alignment, the water conduit is aligned with a jet pump in the lower section, so as to create a suction effect, drawing air through the supported pen point.

DESCRIPTION OF THE PREFERRED EMBODIMENTS

Figure 1:
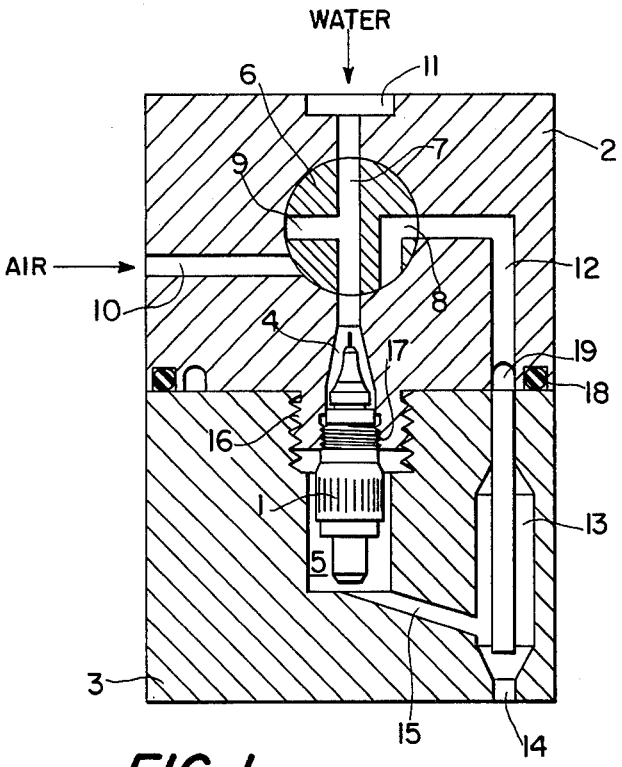
FIG. 1 is a vertical section of the cleaning device, showing a stylographic pen point supported in the cleaning chamber with the two-way valve in the water cleaning attitude.

The invention concerns a device for liquid cleaning and drying of ink pen points, in particular tubular pen points with a generally tubular holder or support for the pen point.

Devices of this kind are well known and include relatively expensive ultrasonic cleaning devices. In all of these devices the ink that has dried up in the pen point reservoir is dissolved with water or a cleaning fluid and is then flushed out of the ink pen point which on occasion calls for the disassembly of the pen point into its component parts prior to washing. After the cleaning process has taken place, as well as after flushing with clear water in order to remove the remaining cleaning fluid, water will remain in the different spaces of the ink pen point, particularly in the capillary spaces. Such water cannot be easily removed.

In order to restore such an ink pen point to its operating condition, the point must be kept stored without using until such time as all traces of water have evaporated, or the point may be heated, if required, until the evaporation of the water has taken place. Also, the user may refill the ink pen point with ink and move the point on a drawing board until such time as a line of adequate blackness is drawn, that is to say until the entire remaining water has been pushed by the flow of the ink out of the pen point and has reached the drawing board pad.

Each of the foregoing possibilities is time-consuming and troublesome, and it is, therefore, an object of the present invention to create a device that on the one hand can accomplish the cleaning of the ink pen point with water and on the other can effect the quick drying of the ink pen point after the water cleaning.

To solve this task, the present cleaning device supports an ink pen point such that the writing tip communicates with a two-way valve and the open ended ink reservoir end communicates with a waterjet pump. The inlet of the jet pump is connected with the two-way valve and in one position of the two-way valve the pen tip communicates with a water supply and in another position of the valve the pen tip communicates with an air source, while the inlet of the waterjet pump is connected with the water supply. The connection with the water supply preferably is threaded.

The device thus permits efficient, simple and rapid cleaning of an ink pen point which is placed into the holder. The cleaning process takes place in that water surging from a conventional threaded connection to a water tap reaches the pen tip through the two-way valve and flushes out the ink within the pen point in such a way that dried up ink is dissolved and removed. In this process the dissolved ink is flushed together with the water through the suction portion of the waterjet pump.

After an adequate cleaning has been accomplished, the two-way valve is inverted and the water flowing through the waterjet pump will thus create a negative pressure at the suction portion of the waterjet pump, resulting in the suction of air through the air supply inlet that is now connected with the pen tip holder area. The air is channeled through the ink pen point which is thus dried simply and quickly.

The air inlet may also be used to have cleaning fluid pass through the ink pen point in an initial cleaning operation. The cleaning fluid is simply pushed through the ink pen point through the suction of the waterjet pump and thereafter flushed with water, prior to air drying.

To achieve a simple assembly of the entire device it may be fashioned as a two section casing, an upper section and a lower section which are connected, but may be taken apart. The upper section may contain the water connection and the two-way valve, and the lower section may contain the waterjet pump while supporting the pen tip in a cleaning chamber. With a construction of this kind it is possible to remove the lower section from the upper section, so that the upper section with its water connection remains threaded to the water spigot while the cleaned ink pen point in the lower section of the holder area may be removed and another ink pen point inserted into the lower section.

The described device consists of a casing with an upper part 2 and a lower part 3, which are connected in a detachable fashion by a threaded lug in the upper part 2 and a tap hole in the lower part forming a threaded or screw joint 16. The uppper part 2 contains a water connection 11 which allows the entire casing to be attached for example to a water tap. This water connection is connected with a two-way valve 6 which can be operated from without the device. Valve 6 water conduit 7 in the position shown in FIG. 1 communicates with the internal cleaning chamber and a support for tubular pen point 1. This support consists of an upper or pen point area 4 located in top section 2 with an internal thread 17 for threaded engagement of the tubular ink pen point 1. The ink reservoir end of point 1 extends into lower area 5 located in bottom section 3. The remaining valve 6 conduits 8 and 9 are closed in the water cleaning position, illustrated in FIG. 1.

Figure 2:
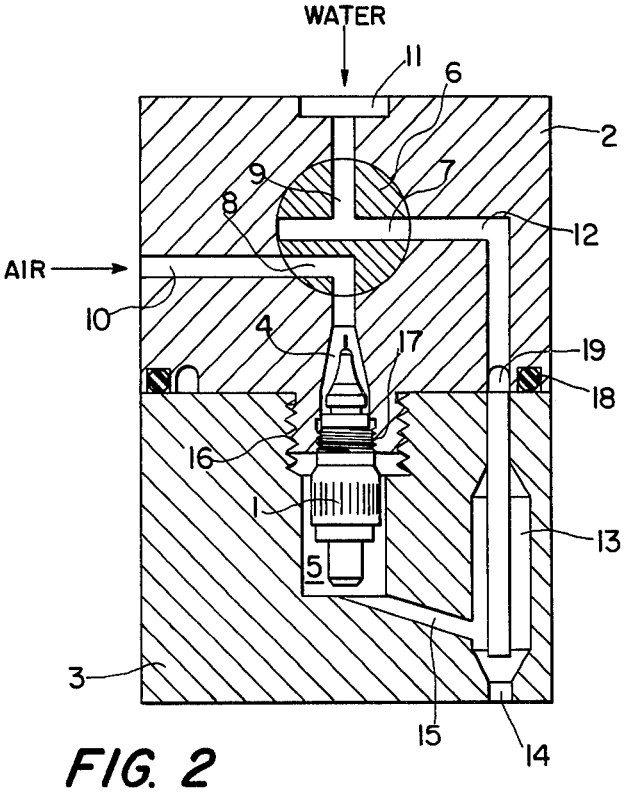
FIG. 2 is a similar vertical section, showing the two-way valve in the air drying position, wherein the air inlet conduit is aligned with the cleaning chamber and the water conduit is aligned with the jet pump.

In bottom section 3 waterjet pump 13 is provided. Pump 13 inlet conduit 12, as illustrated in FIG. 2, may be connected with valve 6 conduit 7. Outflow or drain conduit 14 of waterjet pump 13 is located at the lower surface of bottom section 3. Suction portion 15 of waterjet pump 13 is connected with the overflow side of the lower area 5 adjacent the open ink reservoir end of pen 1. In order to ensure that the portion of conduit located in top section 2 is aligned properly with the portion of the same conduit that is located in bottom section 3, a ring nut 19 is positioned in the top section 2, so as to communicate with the upper part of conduit 12. Ring nut 19 has a radius equal to the distance of conduit 12 from the middle axis of the casing. A washer or O-ring seal 18 may be provided between the two casing surfaces.

If in the water cleaning position of two-way valve 6, as shown in FIG. 1, water under pressure is introduced through the water connection 11, water flows through the valve conduit 7 into the pen holder areas 4 and 5 and flushes through the threadedly supported tubular pen point 1, in such a way that the dried up ink remnants are dissolved and flushed together with the water through suction portion 15 of the waterjet pump and thence through outlet 14.

After completion of cleaning of the tubular ink pen point 1, two-way valve 6 is rotated into the position shown in FIG. 2 in which the valve conduit 8 connects air inlet 10 with the pen holder areas 4 and 5 and the valve conduits 7 and 9 interconnect the water source 11 and inlet conduit 12 of waterjet pump 13. The water that now flows through water jet pump 13 creates in known fashion a negative pressure in suction portion 15, resulting in the suction of air from air inlet 10 through the holder areas 4 and 5 and, simultaneously, thus through the ink pen tubular point 1, resulting in evaporation and removal of any water remaining in the tubular ink pen point.

After drying of the tubular ink pen point 1 in this manner, the water supply is interrupted and the bottom section 3 of the casing is unscrewed from the top section 2, so that the cleaned and dried tubular ink pen point 1 may be unscrewed and removed from the lug portion of top section 2 and, if necessary, another new ink pen tubular point may be screwed into internal threads 17.

As previously was described, the air drying position shown in FIG. 2 may be used, also, to cause cleaning fluid introduced through suction at air inlet 10 to flow through any tubular ink pen point that is to be cleaned. Subsequently, valve 6 may be rotated to the water cleaning position shown in FIG. 1, wherein water is used to remove any remnants of cleaning fluid from the tubular ink pen point, which may then be air dried in the aforedescribed manner.

I claim:

1. A device for cleaning ink pen points comprising:

A. A housing having a lower section and an upper section;

i. said lower section defining:

a. a chamber for support and cleaning of an ink pen point and, b. a jet pump communicable with said chamber, as well as a source of cleaning water and including a drain conduit;

ii. said upper section defining;

a. a lug like extension having an axial bore communicating with said chamber and complementally engagable at its exterior with the wall of said chamber;

b. an air inlet conduit communicating with said chamber in said lower section;

c. a water inlet conduit communicating with said jet pump in said lower section; and d. a valve having water and air conduits therethrough, said valve being rotatably supported intermediate said air inlet conduit and said water inlet conduit in said upper section, so as to be rotatable from a water cleaning position in which said water conduit is aligned with said water inlet conduit and with said chamber, to an air drying position in which said air drying conduit is aligned with said air inlet conduit and with said chamber and said water conduit is aligned said water inlet conduit and with said jet pump.

2. A device for cleaning ink pen points as in claim 1, wherein said upper section and said lower section housing are sealed to each other.

3. A device for cleaning ink pen points as in claim 1, said axial bore of said lug like extension, including internal threads engagable complementally with external threads in a pen point positioned therein.

4. A device for cleaning ink pen points as in claim 3, said axial bore of said lug being conformed complementally with a pen tip end.

5. A device for cleaning ink pen points as in claim 1, said valve in the water cleaning position, closing said air inlet conduit.

* * * * *